US007447118B1

(12) United States Patent
Matos

(10) Patent No.: US 7,447,118 B1
(45) Date of Patent: Nov. 4, 2008

(54) WRISTWATCH WITH INTEGRATED SURVIVAL KIT

(76) Inventor: Ismael Matos, 289 NE. P Hwy., Knob Noster, MO (US) 65336

( * ) Notice: Subject to any disclaimer, the term of this patent is extended or adjusted under 35 U.S.C. 154(b) by 0 days.

(21) Appl. No.: 11/837,770

(22) Filed: Aug. 13, 2007

(51) Int. Cl.
*G04B 37/12* (2006.01)
*G04B 47/00* (2006.01)

(52) U.S. Cl. ..... 368/10; 368/278; 7/163

(58) Field of Classification Search ..... 368/10, 368/276, 278; 7/163, 164
See application file for complete search history.

(56) References Cited

U.S. PATENT DOCUMENTS

| | | | | |
|---|---|---|---|---|
| 1,252,735 A | | 1/1918 | Szabat | |
| 1,355,343 A | | 10/1920 | Korn | |
| D61,220 S | | 7/1922 | Ochse | |
| 4,183,206 A | | 1/1980 | Porsche et al. | |
| 4,478,330 A | * | 10/1984 | Lin | 206/38 |
| 4,727,609 A | * | 3/1988 | Smith, Jr. | 7/145 |
| 5,854,773 A | | 12/1998 | Lee | |
| 6,079,872 A | * | 6/2000 | Besson | 368/281 |
| 6,273,582 B1 | * | 8/2001 | Taggart et al. | 362/119 |
| 7,125,145 B2 | * | 10/2006 | Gardiner et al. | 362/253 |
| 2005/0052955 A1 | * | 3/2005 | Rochat et al. | 368/281 |

FOREIGN PATENT DOCUMENTS

| | | |
|---|---|---|
| CH | 000655633 A | 5/1986 |
| CH | 000677158 A5 | 4/1991 |
| DE | 004130034 A1 | 4/1993 |

* cited by examiner

*Primary Examiner*—Renee Luebke
(74) *Attorney, Agent, or Firm*—Erickson, Kernell, Derusseau & Kleypas, LLC

(57) ABSTRACT

An apparatus that combines a wristwatch with a survival kit includes a wafer component moveably connected to a watch, wherein the wafer further comprises a mirrored surface, a compass and a perimetric cutting edge. The wafer is rotatably attached to the wristwatch to allow movement of the wafer between a closed position and an open position wherein a user may view the compass, provide signaling using the mirror or utilize the cutting tool provided thereon. The wafer is also detachable from the wristwatch to allow the wafer to be utilized in a standalone mode.

16 Claims, 3 Drawing Sheets

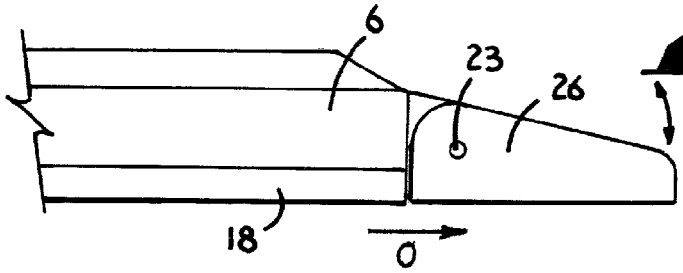
Fig.5A
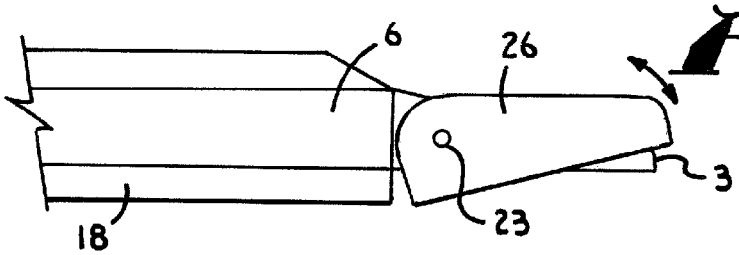
Fig.5B.
Fig.6A.
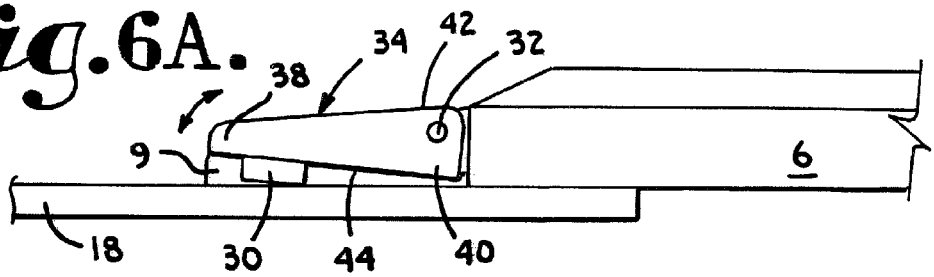
Fig.6B.
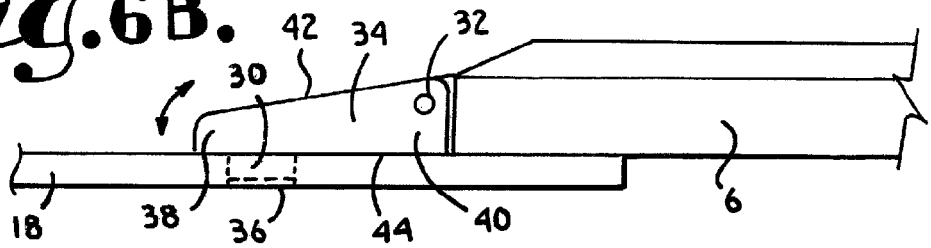
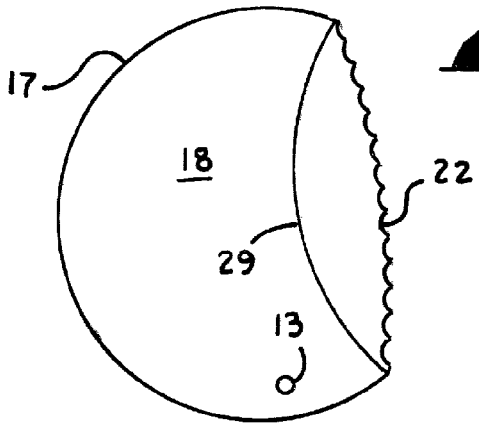
Fig.7.

WRISTWATCH WITH INTEGRATED SURVIVAL KIT

The present invention is directed to an unobtrusive, integrated combination of a wristwatch with a survival kit. The survival kit comprises a navigation and orientation tool, a signaling device and a cutting tool.

BACKGROUND OF THE INVENTION

Watches, including wristwatches and pocket watches, are traditionally available in a variety of shapes and sizes. It is known for watches to have a dial or face for displaying the time and a case having a cavity formed therein behind the dial to house the movement or mechanism of the watch. The side of the case opposite the dial may be covered by a removable case back.

In some instances a separate compartment has been located within the watch case or attached to the case back to hold and/or conceal objects, such as money, tokens, scissors, pocket knives and the like, which are traditionally carried separately. As such, a wide variety and dimension of compartments and devices have developed over the years to provide a solution that allows other objects to be carried within the case of a conventional watch. These traditional multipurpose apparatus typically include single function or single purpose objects.

None of these solutions have addressed or resolved the problems faced by persons with an affinity for the outdoors. An outdoors person, who may participate in fishing, hunting, hiking and the like, would typically have a need for a kit that would contain some basic survival related tools. Such survival tools are ordinarily separate and apart from any other gear that the person may have, including the person's watch. This then requires that the person remember to tote along the survival kit in addition to all the other items that may be needed on the trip.

Remembering to carry the kit and the other items required for the trip can be quite cumbersome and opens up the possibility that something vital for the trip may be forgotten, misplaced or become separated from the person while the trip is underway.

Accordingly, there exists a need for an apparatus that enables some basic and intrinsic survival tools to be easily remembered, transported and remain attached to an individual on an outdoors trip. Such an apparatus provides versatility and addresses the shortcomings that were earlier described and is thus highly desirable. More specifically there exists a need to combine such tools with another item that is typically worn and easily transported on the body of the outdoors person. Even further, there is a need for the arrangement of the apparatus to enable ease of use and flexibility to the end user. Further still, there is a need to provide the survival tools in an aesthetically pleasing packaging for the end user. Such a packaging should be inconspicuous in appearance and require minimal effort and thought for use and transportation by the end-user

BRIEF SUMMARY OF THE INVENTION

The present invention comprises an apparatus that integrates a wristwatch with a multipurpose survival tool kit. The survival kit includes multiple tools and is arranged such that it abuts the case back of a conventional wristwatch. The kit may include, for example, a cutting tool, a reflective surface and a compass, all of which are neatly and unobtrusively integrated with a wristwatch.

In an aspect of the present invention, a substantially oval shaped wafer and a substantially oval shaped pocket are attached to the back or underside of a watch case, wherein the pocket receives a cutting edge portion of the wafer.

In one aspect, the present invention is directed to providing on a wafer, items that may be essential to the survival of an individual. The items are embodied in a compact and aesthetically pleasing survival kit which is integrated with a wristwatch and may be worn by an individual during the course of his normal outdoor activities.

In another aspect, the present invention further provides a removeably coupled compass, mirror and sharp-edge, with a wristwatch.

In an even further aspect, the present invention provides a survival kit that is moveable between a non-operational closed configuration and a variety of open configurations, wherein a compass component is viewable by an end user, wherein a reflective surface may be utilized for signaling and wherein a cutting edge is presentable for use by the end user.

BRIEF DESCRIPTION OF THE DRAWINGS

The present invention is further described with reference to the accompanying drawings, which show a particular construction of the present invention. However, it should be noted that the invention as disclosed in the accompanying drawings is provided for illustrative and descriptive purposes only. The various elements and combinations of elements described below and illustrated in the drawings may be arranged and organized differently to result in constructions which are still within the spirit and scope of the present invention.

FIG. 5A is an enhanced view of the wafer lock of the present invention, illustrating the restriction to movement of the wafer when the wafer lock is a locked position;

FIG. 5B is an enhanced view of the wafer lock of FIG. 5A when the wafer lock is between the locked and an open position;

FIG. 6A is an enhanced view of the retention detent of the present invention, illustrating the relative displacement of the detent as the wafer moves between a closed and open configuration;

FIG. 6B is an enhanced view of the retention detent of the present invention, illustrating the nodule of the wafer detent positioned in the locking recess of the wafer in an open configuration; and FIG. 7 is an illustration of an alternate embodiment of the wafer of the present invention, having a serrated cutting edge.

DETAILED DESCRIPTION OF THE INVENTION

The present invention is directed to an apparatus that provides an ordinary looking timepiece and includes a concealed yet easily accessible set of tools. The tools provide objects that would be critical to the survival of an individual who may be stranded or otherwise lost without access to any form of aide or communication. A section of the apparatus is operable to open and present various survival tools, which may include a navigation and orientation tool, a signaling tool and a cutting tool. The tools are pivotally and securely attached to the timepiece to prevent accidental loss or misplacement, while allowing access for use by the individual. In one embodiment of the present invention, the tools may also be detached from the timepiece to allow standalone use.

Figure 1:
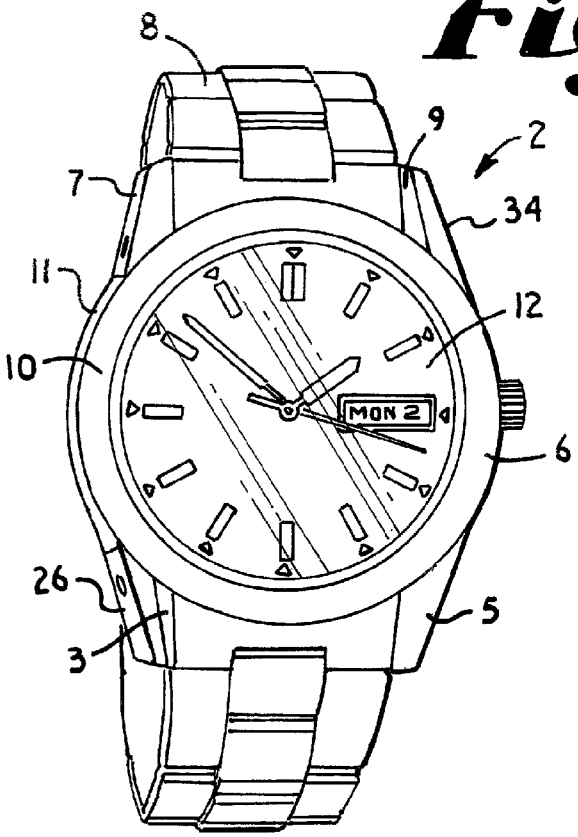
FIG. 1 illustrates a top view of a wrist apparatus of the present invention having a survival kit and watch component, wherein the watch face is in full view.

While the present invention is described herein with reference to a wristwatch, it should be understood that the invention has application to other timepieces and devices including but not limited to pocket watches, bracelets, pendants, handheld devices or buttons. Referring to the drawing figures, a preferred wrist apparatus 2, in accordance with the present invention is shown in FIG. 1. The wrist apparatus 2 comprises a survival kit 4 and a timepiece or watch component 6. The watch component 6 includes a release lug 3, a first lug 5, a second lug 7 and a locking lug 9. The lugs 3, 5, 7 and 9 paired on opposite areas of the wrist apparatus 2 define a pair of openings for receiving and securing a watch band 8 or other implement for attaching the wrist apparatus 2, to the body, garment or other articles of an individual. The lugs 3 and 5 define a first opening and lugs 7 and 9 define a second opening. Lugs 3 and 9 are adapted to attach and abut homologous moveable pieces, namely wafer lock 26 and wafer detent 34 for respectively releasing and retaining components of the survival kit 4.

The watch component 6 further includes a watch case 10, a watch face 12, a case back 14 and a traditional watch movement (not shown), which may be, for example, a manually wound, self-winding or quartz movement. The watch case 10 preferably has a generally cylindrical configuration having a circumferential side 11 bounded on one end by a substantially circular watch face 12 and on the opposing end by a substantially circular case back 14, which together define an interior space for receiving the watch movement.

Figure 2A:
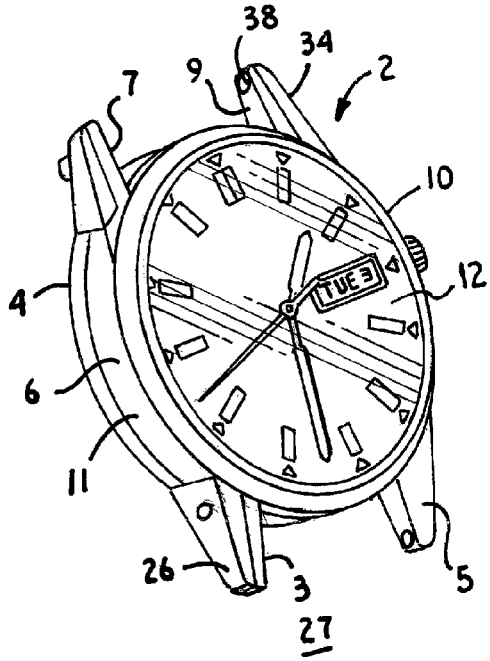
FIG. 2A illustrates a perspective view of the wrist apparatus of FIG. 1.
Figure 2B:
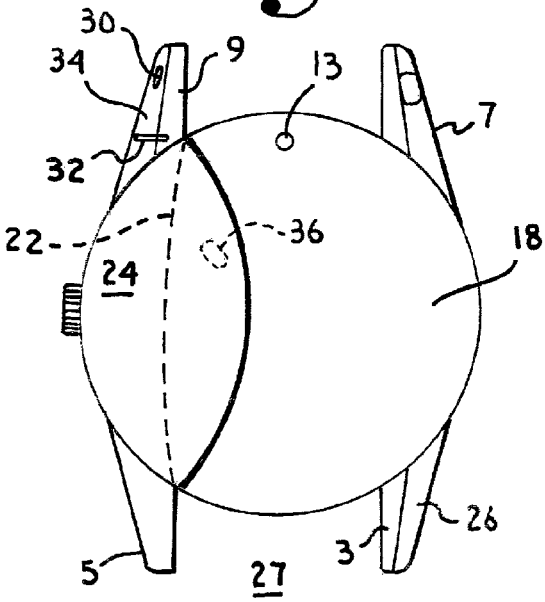
FIG. 2B illustrates a bottom view of the wrist apparatus of FIG. 1.
Figure 3B:
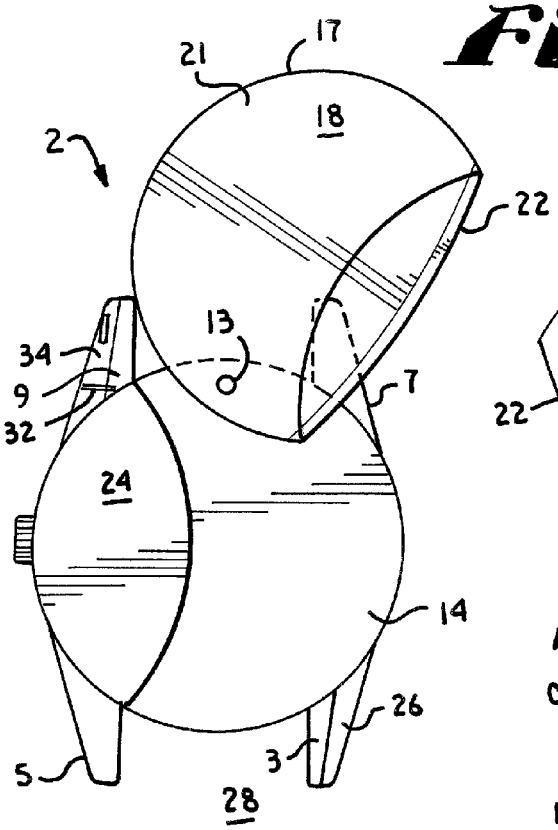
FIG. 3B illustrates a bottom view of the wrist apparatus of FIG. 1 in an open configuration.
Figure 3A:
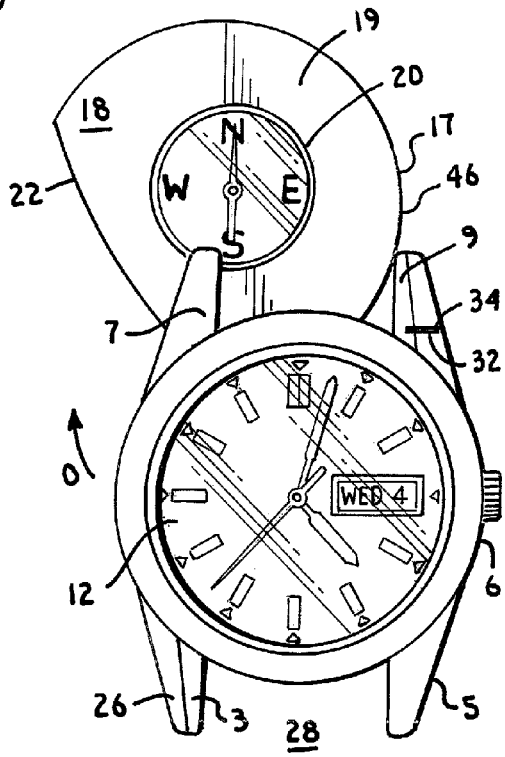
FIG. 3A illustrates a top view of the wrist apparatus of FIG. 1 in an open configuration.

The placement of the survival kit 4 relative to the watch component 6 is best illustrated in perspective view of FIG. 2A. As shown, the survival kit 4 is located on what would be traditionally considered to be the backside of the watch component 6. More specifically, the survival kit 4 is located adjacent to the watch back 14. The watch component 6 and the survival kit 4 may be maintained in a closed configuration 27 as shown in FIGS. 2A and 2B or an open configuration 28 as shown in FIGS. 3A and 3B. In the closed configuration 27, components of the survival kit 4 are not visible and the wrist apparatus 6 is fairly indistinguishable from a traditional wristwatch. Conversely, the open configuration 28 presents all the component tools of the survival kit 4.

The opposite side of the wrist apparatus 2 as illustrated in FIG. 2B reveals the back of the survival kit 4. A pocket plate 24 and a wafer 18 component of the survival kit 4 are visible in this view. In the preferred embodiment, the pocket plate 24 extends across a portion of the watch back 14, and defines an opening or pocket 16 adapted to receive a portion of the wafer 18. The wafer 18 and pocket 16 are located adjacent the watch back 14. More specifically, the wafer 18 is removedly attached to the watch component 6 by a fastening means such as a pin or rivet 13, having a pivot axis 25, such as to allow the rotational movement of the wafer 18 from behind the watch component 6. The wafer 18 is operable to move in a plane that is substantially parallel to the watch back 14. Pivot axis 25 is substantially perpendicular to the watch back 14. Rotation of the wafer 18 about the pivot axis 25 moves the wafer 18 between the closed configuration 27 and the open configuration 28.

Figure 4A:
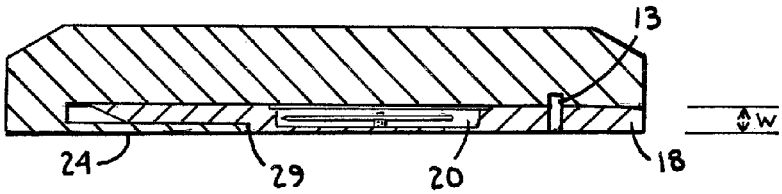
FIG. 4A is a cross sectional view illustrating the wrist apparatus of FIG. 1 in a closed configuration.
Figure 4B:
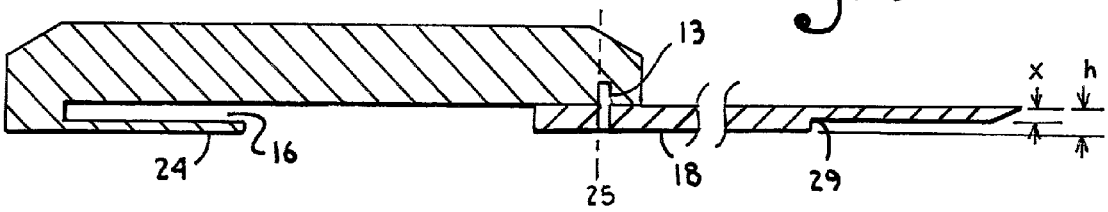
FIG. 4B is a cross sectional view illustrating the wrist apparatus of FIG. 1 in a fully open configuration.

In the preferred embodiment of the present invention, and as shown in FIGS. 3A and 3B, the wafer 18 is substantially oval shaped and comprises a circumferential wafer side surface 17, a reflective first surface 19, a compass 20, an opposing wafer second surface 21 and a cutting edge 22. As would be appreciated by one skilled in the art, the shape and dimensions of the wafer 18 may be varied in any of a number of ways without departing from the scope of the present invention. For example, the wafer 18 cross-section perpendicular to the plane of the opposing surfaces 19, 21, may be oval shaped, rectangular shaped, v-shaped, boat shaped, semi-circularly shaped or any other shape variation. Further still, and consistent with the shape of the wafer 18, the corresponding circumferential wafer side surface 17 may have a consistent width W around the entire wafer 18 or have different widths at different portions of the wafer 18. FIGS. 4A and 4B illustrate wafer 18 with a substantially rectangular cross-section and varying widths W and X. The portion of the wafer 18 that is received in the pocket 16 has a width X, while the remainder of the wafer 18 has a width W.

Returning to FIGS. 3A and 3B, the illustrated compass 20 may be affixed to the reflective first surface 19. Alternatively, the compass 20 may be embossed into the reflective first surface 19. In another alternative and as is more readily apparent in FIG. 4A, the compass 20 may be located within a recessed portion of the wafer 18.

Cutting edge 22 circumscribes a portion of the wafer side surface 17. The cutting edge 22 may be formed in any of a number of known ways, including a method of merely narrowing the width X to a xyresic edge, or by affixing a substantially planar xyresic strip to the appropriate portion of the wafer side surface 17. The cutting edge 22 may be smooth, serrated as shown in FIG. 7 or have any other contoured surface variation.

The second surface 21 of the wafer 18 defines the exterior surface of the survival kit 4 and lies opposed to the watch face 12 of the wrist apparatus 2. In the preferred embodiment of the present invention, the second surface 21 of the wafer 18 is generally adjacent to the wrist of a person wearing the wrist apparatus 2.

Continuing with FIG. 4A, a cross section of the wrist apparatus 2 illustrates in greater detail the pocket 16 defined between the watch back 14 and the pocket plate 24. The pocket 16 is located and dimensioned to receive the cutting edge 22 and a portion of the wafer 18 when the wrist apparatus 2 is in the closed configuration 27. More specifically, the pocket 16 is adapted to be a receptacle for the cutting edge 22 of the wafer 18 and thus provide a protective sheath. In one embodiment of the present invention, a groove 29 is provided along a chord of the wafer 18. The groove 29 is dimensioned to interface the plate 24 so as to provide a substantially planar and level back side for the wrist apparatus 2. In the closed configuration 27, the wafer 18 and watch component 6 are somewhat concentric, and the wafer 18 is obscured from view behind the watch face 12.

When the wafer 18 is partially received or the cutting edge 22 is received within the pocket 16, i.e. in the closed configuration 27, the wafer 18 is held in position by a wafer lock 26 or other latching or arresting means. The wafer lock 26 may be a slide lock movement that engages a portion of the pocket 16 so as to prevent the movement of the wafer 18. The wafer lock 26 may also be a clasp or other similar movement typically utilized for arresting the movement or removal of jewelry pieces or similarly sized items. Optionally, the wafer 18 may also be held in position by a friction fit against the watch back 14 or within the pocket 16, somewhat similar to a pocket knife arrangement and/or operation. Also, in the closed configuration 27, the wrist apparatus 2 has the appearance of a traditional watch. In other words, in the closed configuration 27, the survival kit 4 is unobtrusive to the normal appearance, function or use of the watch component 6, until a user decides to deploy the wafer 18.

The wafer 18 is pivotally fastened by a pin, rivet of other fastening means that will enable rotation of the wafer 18 about a pivot axis 25. Pivot axis 25 is substantially perpendicular to the general plane of the wrist apparatus 2. Rotation of the wafer 18 about the pivot axis 25 moves the wafer 18 between the closed configuration 27 and the open configuration 28. In order to move the wafer 18, the wafer lock 26 is disengaged.

Wafer lock 26 or other fastening mechanism earlier described for retaining the wafer 18 in the closed position 27 is overcome by the user. Preferably, wafer lock 26 is pivotally moved about the axis of a lock pin 23. As shown in FIGS. 5A and 5B, the release of the wafer lock 26 i.e. the rotational movement of the latch 26 about the lock pin 23 removes any hindrance to the movement of the wafer 18 in the direction O. The wafer lock 26 is dimensioned and located relative to the release lug 3, so as to allow a rotation of the wafer lock 26 and enable the wafer 18 to be freely moved. Movement of the wafer 18 in the direction O results in a rotation of the wafer 18 about the pivot axis 25, and from behind the timepiece 6. In the preferred embodiment, the wafer 18 rotates in a clockwise direction from behind the watch component 6 to expose the survival kit 4. The continued rotation of the wafer 18 culminates in the open configuration 28.

In the open configuration 28, the wafer 18 and the watch component 6 are eccentric. The cutting edge 22 is fully exposed, as are the compass 20 and the reflective surface 19. Also noteworthy is the fact that in the open configuration 28, the wafer 18 is retained in place by a wafer detent 34 having a nodule 30. The wafer detent 34 is rotatably coupled to the locking lug 9. In operation, the wafer detent 34 resiliently snap locks or clicks into a dimple or lock recess 36, that is defined in the reflective surface 19 of the wafer 18.

FIGS. 6A and 6B illustrate in greater detail, the wafer detent 34 of the present invention and the lock recess 36. As shown, the wafer detent 34 has a distal area 38 and a proximate area 40, wherein the proximate area 40 is located adjacent the watch case 10. The wafer detent 34 also having a face surface 42 and back surface 44, wherein the face surface 42 is co-directional with the watch face 12 and the back surface is co-directional with the case back 14. The nodule 30 protrudes from the back surface 44 of the distal area 38 of the wafer 34. The wafer detent 34 may be dimensioned and sized to match the locking lug 9. The wafer detent 34 is moveably coupled to the locking lug 9 by a detent pin 32. The detent pin 32 passes through the proximate area 40 to attach the wafer detent 34 to the locking lug 9. The wafer detent 34 is shaped and positioned relative to the watch case 10, so as to allow rotational movement about the detent pin 32. The rotation of the wafer detent 34 is in a plane that is approximately perpendicular to the plane of the watch case 10. The wafer detent 34 may be spring-loaded or otherwise biased in any one of a number of known methods to cause the wafer detent 34 to normally rest and return to a resting position that places the wafer detent 34 in substantial alignment with the lug 9. In the resting position, the face surface 42 and back surface 44 are substantially aligned with corresponding surfaces of the lug 9.

In operation, the movement of the wafer 18 from the closed configuration 27 to the open configuration 28 involves an interaction among the various components of the wristwatch apparatus 2. Specifically, the wafer lock 26, which prevents unintentional rotation of the wafer 18, must first be disengaged to allow movement of the wafer 18 relative to the watch component 6. In other words, the wafer lock 26 is rotated so as to allow the wafer 18 to move in the direction O. As the wafer 18 is rotated into the open configuration 28, leading edge 46 of the wafer 18 contacts the nodule 30. A combination of the shape of the leading edge 23, the shape of the nodule 30 and the interaction there between, results in a displacement and consequently rotation of the wafer detent 34 in the direction of the watch face 12. This action allows the wafer 18 to swing through towards the open configuration 28. When the wafer reaches the position of the open configuration 28, the nodule 30 of the wafer detent 34 comes into alignment with the locking recess 36, located on the wafer 18. The resilient action of the wafer detent 34, enabled by a spring or other means, causes the wafer detent 34 to rotate towards the normal resting position i.e. a direction towards the watch back 14, causing the nodule 30 to engage the locking recess 36 and arrest the wafer 18 in the open configuration 28. As would be appreciated by one skilled in the art, the movement of the wafer detent 34 may also be manually initiated rather than through the described interaction between the nodule 30 and the wafer 18. The wafer detent 34 is preferably disengaged to allow return of the wafer 18 to the closed configuration 27. The wafer detent 34 is disengaged by a lifting action to counteract the spring action and cause the nodule 30 to disengage the locking recess 36.

In the open configuration 28, the reflective surface 19 of the present invention is exposed and may be used for signaling, the compass 20 is visible to the user for use in navigation and the cutting edge 22 is exposed and usable by the end user as needed.

In a further embodiment of the present invention, the wafer 18 is detachable from the watch back 14, by removal of the wafer pin 13, to allow the wafer to be used in a standalone mode.

From the foregoing, it will be seen that this invention is one well adapted to attain all the ends and objects hereinabove set forth together with other advantages which are obvious and which are inherent to the method and apparatus. It will be understood that certain features and sub combinations are of utility and may be employed without reference to other features and sub combinations. This aspect is contemplated by and is within the scope of the claims. Since many possible embodiments of the invention may be made without departing from the scope thereof, it is also to be understood that all matters herein set forth or shown in the accompanying drawings are to be interpreted as illustrative and not limiting The constructions described above and illustrated in the drawings are presented by way of example only and are not intended to limit the concepts and principles of the present invention. As used herein, the terms "having" and/or "including" and other terms of inclusion are terms indicative of inclusion rather than requirement.

What is claimed is:

1. A portable apparatus comprising:

a watch component having, a watch face, a watch movement and an opposing watch back; and a survival kit having a wafer and a pocket;

said wafer and said pocket attached to said watch component, adjacent said watch back;

said wafer comprising:

a reflective surface;

a compass; and a cutting edge portion;

said compass located on a portion of said reflective surface and said cutting edge portion defined circumferentially about a portion of said wafer;

said pocket adapted to receive said cutting edge portion;

said wafer movably connected to said watch component to allow rotation of said wafer whereby said wafer may extend laterally of said watch component to expose said reflective surface, compass and cutting edge portion.

2. The portable apparatus of claim 1, wherein said watch component is a wristwatch.

3. The portable apparatus of claim 1, wherein said watch component is a pocket watch.

4. The portable apparatus of claim 1 further comprising means for restricting unintentional rotation of said wafer.

5. The portable apparatus of claim 4, wherein said means for restricting unintentional rotation is latchable.

6. The portable apparatus of claim 4, wherein said means for restricting unintentional rotation is friction based.

7. The portable apparatus of claim 1 further comprising means for locking the wafer in the laterally extended position.

8. A portable apparatus comprising:

a timepiece means; and a survival kit means;

said survival kit means comprising signaling means, navigation means and a cutting means;

said survival kit means moveably attached to said timepiece means, wherein said survival kits means is rotatable to extend laterally of said timepiece means to enable access to said signaling means, navigation means and cutting means.

9. The portable apparatus of claim 8, wherein the timepiece means is wearable by an individual as a decorative piece.

10. The portable apparatus of claim 8 further comprising means for preventing unintentional rotation of said survival kit means.

11. The portable apparatus of claim 10, wherein said means for preventing unintentional rotation includes a spring loaded locking mechanism.

12. The portable apparatus of claim 11, wherein said spring loaded locking mechanism is located adjacent a lug of said portable apparatus.

13. The portable apparatus of claim 10 wherein said means for preventing unintentional rotation provides a friction between said survival kit means and said timepiece means.

14. The portable apparatus of claim 8 further comprising means for maintaining the survival kit means in the laterally extended position.

15. A portable apparatus comprising:

a watch component having, a watch face, an opposing watch back and a watch movement located there between; and a survival kit comprising a wafer and a pocket;

said wafer and said pocket located adjacent said watch back;

said pocket affixed to said watch component;

said wafer having a reflective surface, a compass and a cutting edge portion, wherein said pocket is adapted to receive the cutting edge portion of said wafer;

said wafer rotatable in a plane substantially parallel to said watch back, to extend said wafer laterally of the watch component and expose said reflective surface, said compass and said cutting edge portion.

16. The portable apparatus of claim 15 wherein said wafer is detachable from said watch component.

* * * * *